United States Patent [19]

Staerzl et al.

[11] Patent Number: 4,777,913

[45] Date of Patent: Oct. 18, 1988

[54] AUXILIARY FUEL SUPPLY SYSTEM

[75] Inventors: Richard E. Staerzl; Norman H. Radtke, both of Fond du Lac; Leonard S. Hummel, Vandyne, all of Wis.

[73] Assignee: Brunswick Corporation, Skokie, Ill.

[21] Appl. No.: 59,791

[22] Filed: Jun. 9, 1987

[51] Int. Cl.[4] ..... F02B 33/04

[52] U.S. Cl. ..... 123/73 A; 123/447

[58] Field of Search ..... 123/73 A, 73 AV, 419, 123/436, 447, 456, 452, 448

[56] References Cited

U.S. PATENT DOCUMENTS

| | | | |
|---|---|---|---|
| 2,937,636 | 5/1960 | Aldinger et al. | 123/452 |
| 3,187,733 | 6/1965 | Heintz | 123/447 |
| 3,749,070 | 7/1973 | Oishi et al. | 123/491 |
| 3,931,808 | 1/1976 | Rachel | 123/179 L |
| 4,114,570 | 9/1978 | Marchak et al. | 123/179 G |
| 4,184,460 | 1/1980 | Harada et al. | 123/491 |
| 4,243,009 | 1/1981 | Staerzl | 123/435 |
| 4,286,553 | 9/1981 | Baltz et al. | 123/73 A |
| 4,312,214 | 1/1982 | Kramer et al. | 73/35 |
| 4,312,314 | 1/1982 | McChesney et al. | 123/438 |
| 4,327,691 | 5/1982 | Moser | 123/179 L |
| 4,349,000 | 9/1982 | Staerzl | 123/491 |
| 4,391,254 | 7/1983 | Staerzl | 123/478 |
| 4,421,088 | 12/1983 | Seilly | 123/447 |
| 4,429,673 | 2/1984 | Staerzl | 123/491 |
| 4,478,068 | 10/1984 | Bonitz et al. | 73/35 |
| 4,481,924 | 12/1984 | Kobayashi | 123/425 |
| 4,498,434 | 2/1985 | Baltz et al. | 123/187.5 R |
| 4,509,472 | 4/1985 | Slattery | 123/73 A |
| 4,521,769 | 6/1985 | Dudeck et al. | 123/479 |
| 4,528,955 | 7/1985 | Sugiura | 123/425 |
| 4,542,726 | 9/1985 | Baltz et al. | 123/73 A |
| 4,554,896 | 11/1985 | Sougawa | 123/179 G |
| 4,621,602 | 11/1986 | Furuyama | 123/425 |
| 4,664,083 | 5/1987 | Nix et al. | 123/425 |
| 4,667,637 | 5/1987 | Staerzl | 123/435 |
| 4,671,220 | 6/1987 | Inoue et al. | 123/73 A |
| 4,674,448 | 6/1987 | Steiger | 123/447 |

FOREIGN PATENT DOCUMENTS

| | | | |
|---|---|---|---|
| 199919 | 12/1982 | Japan | 73/35 |

*Primary Examiner*—Charles J. Myhre
*Assistant Examiner*—David A. Okonsky
*Attorney, Agent, or Firm*—Andrus, Sceales, Starke & Sawall

[57] ABSTRACT

An auxiliary fuel supply system is provided for a two cycle internal combustion engine (302). A first fuel line (350) supplies fuel from the fuel pump (338) to a solenoid (352) which is continuously cyclable between ON and OFF states during running of the engine, including high speed operation where detonation may occur. Fuel then flows through a second fuel line (354) to a restriction orific metering housing (356), and then to a plurality of third branch fuel lines (358, 384, 386, 388, 390 and 392) for delivery to respective cylinders. The restriction orifices provide a pressure drop from the second fuel line to the plurality of third fuel lines, to provide lower fuel pressure in the third fuel lines, to reduce the chance of leakage at the intake manifold (326), and also to reduce fuel pressure fluctuations in the third fuel lines otherwise due to cycling of the solenoid. Metering housing structure is disclosed. The solenoid is controlled by a variable duty cycle oscillator (408), which in turn is controlled by a fuel enrichment signal (84) output by an electronic control which is responsive to engine knock and/or temperature. Control circuitry is disclosed.

22 Claims, 4 Drawing Sheets

AUXILIARY FUEL SUPPLY SYSTEM

CROSS REFERENCE TO RELATED APPLICATIONS

Reference is made to commonly owned co-pending U.S. application Ser. No. 07/059,792, filed on even date herewith and U.S. application Ser. No. 07/060,978, filed on even date herewith.

BACKGROUND AND SUMMARY

The invention provides a fuel supply system for a two cycle internal combustion engine, including an auxiliary fuel enrichment system for preventing knock, and for enhancing operation when the engine is cold.

The auxiliary fuel enrichment system includes a first fuel line connected from the fuel pump to a continuously cyclable control valve, a second fuel line connected from the valve to metering restriction orifice structure, and a third fuel line connected from the orifice structure to the engine intake manifold for supplying fuel to the crankcase. The restriction orifice structure lowers the fuel pressure in the third fuel line to reduce the chance of fuel leakage at the intake manifold, and reduces fuel pressure fluctuations in the third fuel line otherwise due to cycling of the control valve between ON and OFF states.

The control valve is preferably a solenoid controlled by a variable duty cycle oscillator between ON and OFF states. The oscillator may be controlled by knock detection circuitry and/or temperature sensing circuitry.

DETAILED DESCRIPTION

Figure 1:
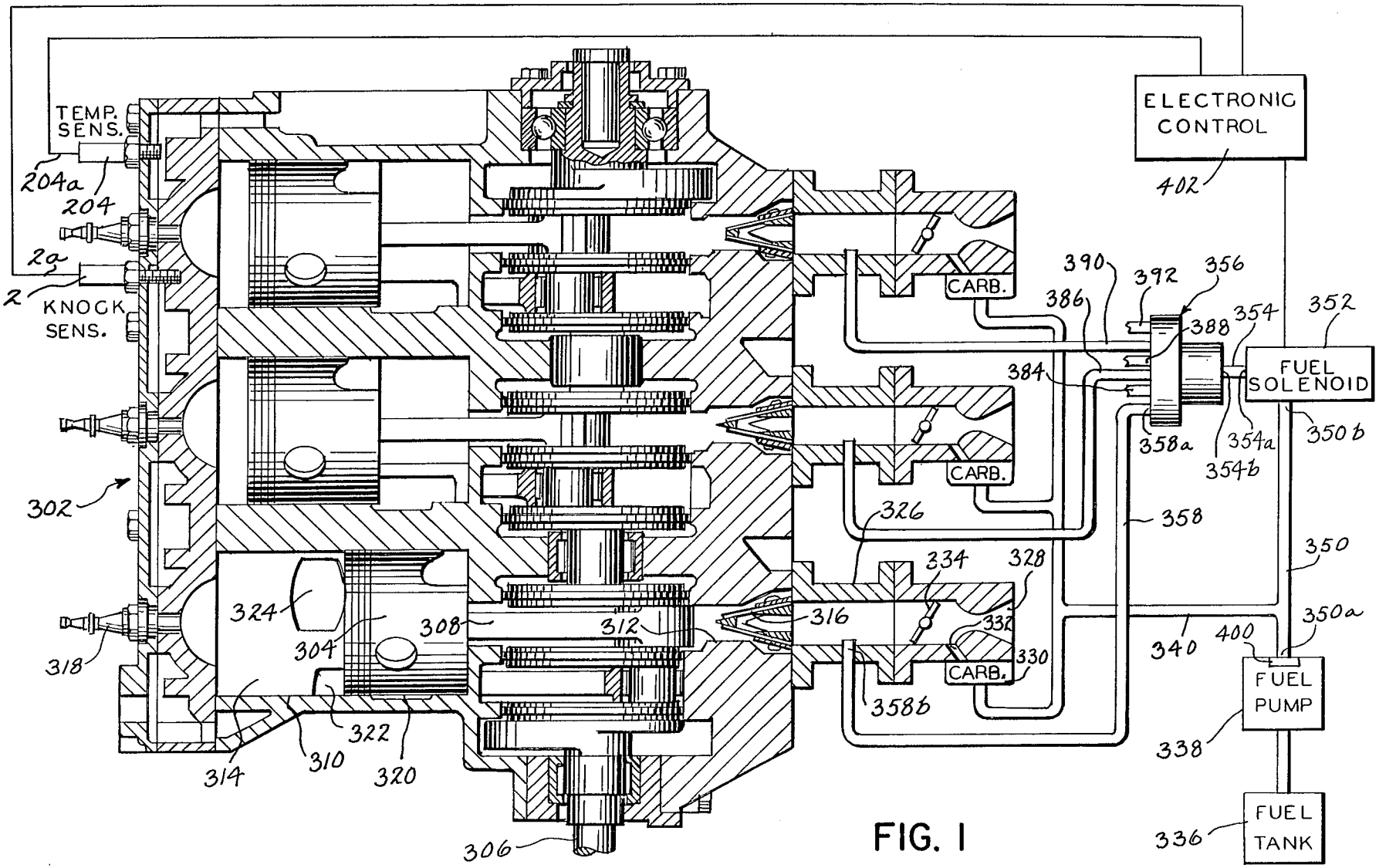
FIG. 1 is a sectional view through one of the cylinder banks of a V-6 marine internal combustion engine, and also schematically shows control circuitry.

FIG. 1 shows a two cycle internal combustion engine 302 having a plurality of pistons 304 connected to a vertical crankshaft 306 by connecting rods 308. FIG. 1 shows one bank of three cylinders in a V-6 engine. Piston 304 is reciprocal in cylinder 310 between crankcase 312 and combustion chamber 314. Piston 304 moves to the left during its intake charging stroke drawing a fuel-air through one-way reed valves 316 into crankcase 312. Piston movement to the left also compresses the fuel-air mixture in cylinder 310 for ignition by spark plug 318, which combustion drives piston 304 to the right generating its power stroke. During the movement of piston 304 to the right, the crankcase is pressurized and the fuel-air mixture in crankcase 312 is blocked by one-way reed valves 316 from exiting the crankcase, and the mixture is instead driven through fuel-air transfer passage 320 to port 322 in cylinder 310 for compression during the intake stroke, and so on to repeat the cycle, all as is known. The combustion products are exhausted at port 324. Intake manifold 326 supplies a fuel-air mixture to the crankcase. Air is supplied at inlet 328, and fuel is supplied by carburetor 330 through orifice 332. Butterfly valve 334 provides throttle control. Fuel from tank 336 is drawn by fuel pump 338 and supplied on fuel line 340 to the float bowls of the carburetors.

In accordance with the present invention, an auxiliary fuel enrichment system is provided. A first fuel line 350 has an inlet **350*a* connected to fuel pump 338, and an outlet 350*b*. A fuel control valve is provided by a solenoid 352 connected to outlet 350*b* of fuel line 350. Solenoid 352 has an OFF state blocking fuel flow from fuel line 350, and has an ON state passing fuel flow from fuel line 350. Solenoid 352 is a Brunswick Corp. Mercury Marine Part No. 43739 solenoid valve and is continuously operable between the ON and OFF states during running of the engine, including high speed operation where detonation may occur. A second fuel line 354 has an inlet 354*a* connected to solenoid 352, and has an outlet 354*b*. Solenoid 352 blocks fuel flow from fuel line 350 to fuel line 354 in the OFF state, and passes fuel flow from fuel line 350 to fuel line 354 in the ON state. Metering orifice structure 356 is connected to outlet 354*b* of fuel line 354 and has a given restriction orifice metering fuel flow, to be described. A third fuel line 358 has an inlet 358*a* connected to metering orifice structure 356 and receives fuel flow across the restriction orifice from fuel line 354. The restriction orifice for fuel line 358 is shown at 360 in FIG. 3 for the lower orifice. FIG. 4 shows an enlarged view of the upper orifice 362. Restriction orifice 360 provides a pressure drop thereacross from fuel line 354 to fuel line 358 to provide lower fuel pressure in fuel line 358. Restriction orifice 360 also reduces fuel pressure fluctuations in fuel line 58 otherwise due to cycling of solenoid control valve 52 between the ON and OFF states. Third fuel line 358 has an outlet 358*b* connected to intake manifold 326 to supply extra fuel thereto. The reduced fuel pressure in fuel line 358 reduces the chance of fuel leakage at intake manifold 326. Restriction orifice 360 is less prone to contamination because of its remote location from intake manifold 326**.

Figure 2:
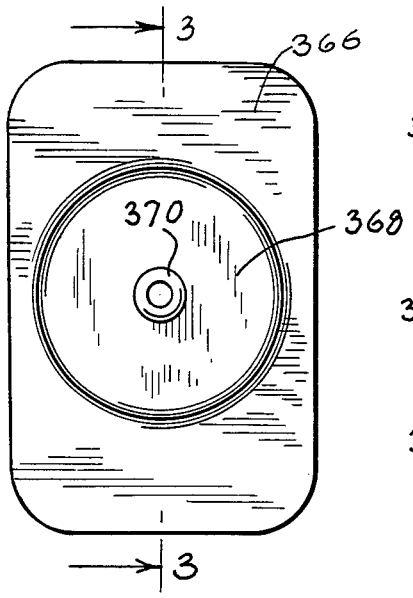
FIG. 2 is an enlarged side view of the metering restriction orifice housing of FIG. 1.
Figure 3:
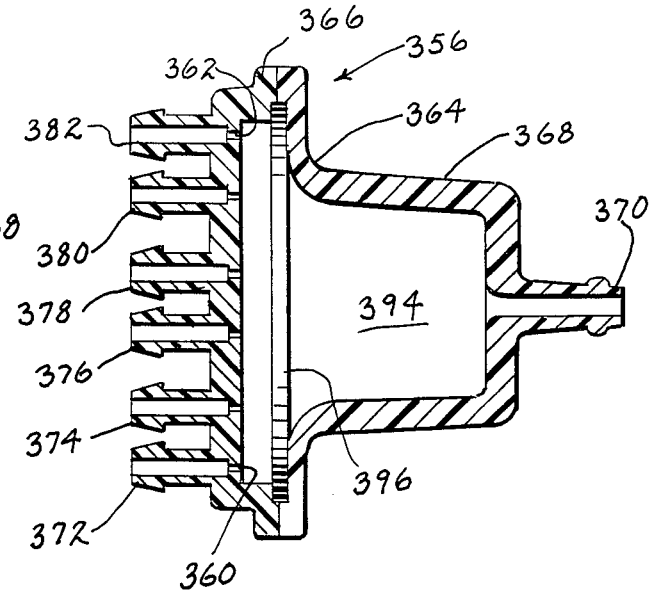
FIG. 3 is a sectional view taken along line 3—3 of FIG. 2.
Figure 4:
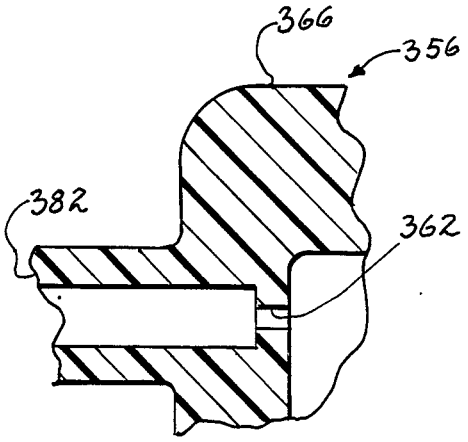
FIG. 4 is an enlarged view of a portion of the structure in FIG. 3.

Metering orifice structure 356 is provided in an integral housing 364, FIGS. 2–4. The housing has a generally rectangular base section 366, and a cylindrical inlet head section 368 extending therefrom, out of the page as seen in FIG. 2, and rightwardly as seen in FIG. 3. Cylindrical head section 368 has an inlet 370 connected to outlet **354*b* of fuel line 354. Base section 366 of housing 364 has six outlets 372, 374, 376, 378, 380 and 382, one for each cylinder. There are likewise six respective fuel lines 358, 384, 386, 388, 390 and 392, one for each cylinder. Each of the outlets of housing 364 is connected to a respective inlet of a respective one of the noted fuel lines 358, 384, 386, 388, 390 and 392**.

Figure 5:
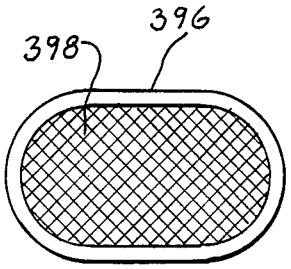
FIG. 5 is an isolated view of the filter in the structure of FIG. 3.

Housing 364 defines an internal plenum 394 common to housing inlet 370 and each of housing outlets 372, 374, 376, 378, 380 and 382. A fuel filter 396, FIGS. 3 and 5, is mounted within plenum 394 between base section 366 and head second 368. Fuel flow from housing inlet 370 to the housing outlets passes leftwardly in FIG. 3 through filter 396. Filter 396 includes a 75 micron mesh 398, meaning that such filter will block particles having a diameter greater than 75 microns. This is substantially finer than the typical 150 micron filter 400 usually inserted immediately downstream of fuel pump 338. Restriction orifice 360 has a diameter of about 0.015 inch. This is substantially smaller than carburetor fuel flow orifice 332 which is typically about 0.06 inch. Restriction orifice 360 is operating at the discharge pressure of fuel pump 338, usually about 10 pounds per square inch, rather than at the low pressure in the carburetor and at carburetor orifice 332, essentially engine vacuum.

Figure 6:
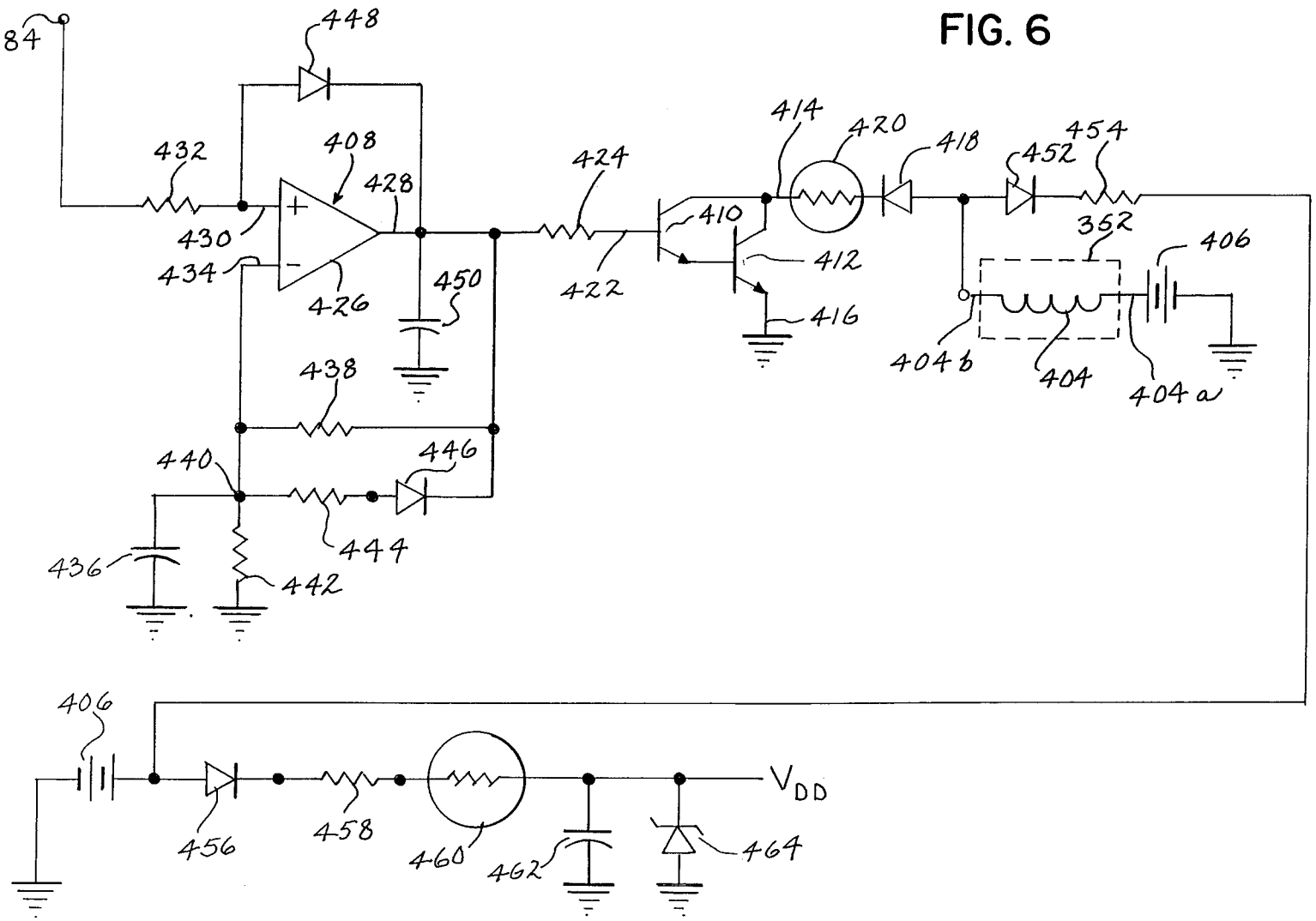
FIG. 6 is a circuit diagram of a portion of the circuitry in FIG. 1.
Figure 7:
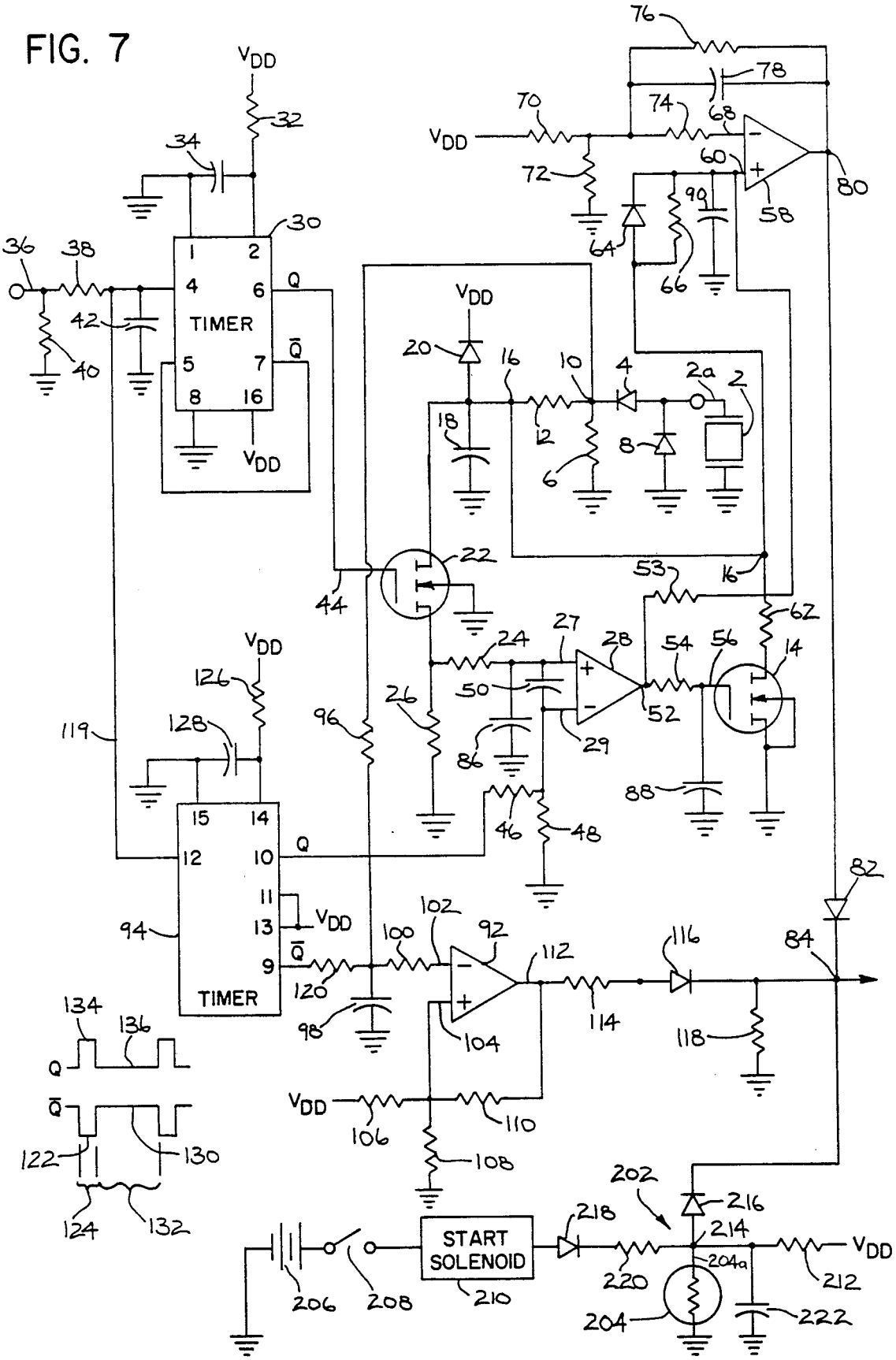
FIG. 7 is a circuit diagram of the knock detection and temperature sensing circuitry in FIG. 1.

Electronic control 402, FIG. 1 includes the circuitry shown in FIGS. 6 and 7 for controlling solenoid 352. Solenoid 352 has a coil 404 with a terminal 404*a* connected to battery 406 to be energized thereby. Conduction of current from battery 406 through solenoid coil 404 is controlled by a fuel mixture signal provided by a fuel enrichment signal at node 84, to be described. A variable duty cycle oscillator 408 is connected to coil 404 of solenoid 352 and has a cycle with an ON portion actuating solenoid 352 to its ON state, and has an OFF portion actuating solenoid 352 to its OFF state. The fuel enrichment signal at node 84 varies the duty cycle of oscillator 408. Solenoid 352 is continously cyclable between its ON and OFF states. A longer ON state increases fuel flow to the engine.

A Darlington transistor pair is provided by NPN bipolar transistors 410 and 412 having main terminals 414 and 416 connected in series with solenoid coil 404 and completing a circuit from battery 406 through solenoid coil 404 through diode 418 through PTC, positive temperature coefficient, thermistor 420 through the transistors to ground, when the transistors are conductive. The transistor pair has a base or control terminal 422 for biasing the transistors into conduction. Biasing of transistor 410 into conduction supplies base drive to transistor 412 which in turn biases the latter into conduction. Oscillator 408 is connected through resistor 424 to transistor control terminal 422 and biases the transistors into conduction during the ON portion of the oscillator cycle. The transistors are nonconductive during the OFF portion of the oscillator cycle.

Variable duty cycle oscillator 408 includes a comparator 426, provided by an operational amplifier. Comparator 426 has an output 428 connected through resistor 424 to control terminal 422. Comparator 426 has a noninverting input 430 receiving the fuel enrichment signal from node 84 through resistor 432. Comparator 426 has an inverting input 434 connected to a capacitor 436 which is charged by the output of comparator 426 through a resistor 438 which is connected from output 428 to a node 440 between capacitor 436 and input 434. A voltage limiter is provided by resistor 442 connected from ground to node 440 to limit the voltage at comparator input 434. Comparator input 434 provides a reference voltage determined by the charge on capacitor 436 for comparison against the voltage at comparator input 430. Comparator output 428 transitions high when the voltage at input 430 exceeds the voltage at input 434. Comparator output 428 transitions low when the charge on capacitor 436 and the voltage at input 434 exceeds the voltage at input 430. When the fuel enrichment signal through resistor 432 at comparator input 430 exceeds a given value, such as at high rpm where detonation is likely to occur, to be described, comparator output 428 remains high because resistor 442 prevents the voltage at comparator input 434 from exceeding that at comparator input 430, such that transistors 410 and 412 remain conductive, and solenoid 352 remains in its ON state and does not cycle to the OFF state, to provide maximum fuel enrichment.

Resistor 444 is connected in series with diode 446, and they are connected in parallel with resistor 438 from node 440 to comparator output 428. Capacitor 436 charges from comparator output 428 through resistor 438, and discharges through resistor 444 and diode 446. Diode 448 provides a voltage drop and is connected between comparator input 430 and comparator output 428. When the charge on capacitor 436 and the voltage at comparator input 434 exceeds the voltage at comparator input 430, and comparator output 428 transitions low. Diode 448 lowers the voltage at comparator input 430 to a given voltage difference above the voltage at comparator output 428 such that capacitor 436 must discharge to a level below the lowered voltage of comparator input 430 before comparator output 428 can again transition high. Filtering capacitor 450 provides noise suppression.

PTC thermistor 420 is heated by excessive current flow therethrough to a blocking condition to block current flow through transistors 410 and 412, to protect the latter from a defective or shorted solenoid coil 404. Solenoid terminal 404*b* is connected through diode 452 and resistor 454 to the positive terminal of battery 406. When transistors 410 and 412 are ON, current flows as above described from battery 406 through solenoid coil 404 and diode 418 and thermistor 420. When transistors 410 and 412 turn OFF, inductive current from solenoid coil 404 flows through diode 452 and resistor 454 to battery 406, to limit inductive current during cycling of the solenoid.

Battery voltage is applied across diode 456, resistor 458 and PTC thermistor 460, and is filtered by capacitor 462 and limited by zener diode 464 to provide voltage reference source $V_{DD}$ for various electronic components, to be described. PTC thermistor 460 provides a resettable fuse which is heated by excessive current flow from battery 406 to a blocking condition to protect such electronic components.

FIG. 7 shows knock detection and temperature sensing circuitry for providing the fuel enrichment signal at node 84. Knock sensor transducer 2 has an output line 2*a* to the electronic control circuitry. Temperature sensor 204 has an output line 204*a* to the electronic control circuitry 402.

The knock detection circuit includes an audio transducer 2, for example as commercially available from Telex Corporation, formerly Turner Microphone, of Minneapolis, Minn., mounted to the cylinder head of the cylinder most prone to knocking, U.S. Pat. Nos. 4,243,009, 4,349,000 and 4,667,637, incorporated by reference. As in incorporated U.S. Pat. No. 4,667,637 the audio transducer is preferably tuned to the mechanical resonant frequency of the cylinder to enhance the efficiency of the transducer. Audio transducer 2 senses audio signals indicative of engine combustion and occurring within the combustion chamber of the engine and converts the audio signals into an electrical output voltage on line 2*a*, including a portion representing background noise and a portion representing detonation.

As noted in incorporated U.S. Pat. No. 4,667,637 for each engine cycle, the transducer output signal voltage is characterized by one phase during which detonation is unlikely to occur and by another phase during which any detonation is likely to occur. Immediately following the ignition signal for the respective cylinder, there is a dead-time interval of approximately 1 or 1.5 milliseconds during which detonation is unlikely to occur. During this interval, there is a buildup of pressure and heat, but usually no detonation, and hence transducer 2 only senses background noise during such interval. Following this first interval, there is a second interval which lasts until the next ignition pulse. Detonation, if any, is likely to occur during the second interval. In the present invention, the first interval is used for sampling sensed background noise and adjusting transducer output voltage.

Transducer 2 has an AC output which is rectified through diode 4 having a ground reference resistor 6. The other half cycle is conducted through diode 8. The rectified transducer output voltage at node 10 is fed through a voltage divider network provided by resistor 12 and FET 14 to provide a transducer output voltage at node 16 which varies according to conduction of FET 14. The more conductive FET 14, the more current it conducts to ground, and the lesser the voltage at node 16. Conversely, if FET 14 becomes less conductive, it conducts less current to ground, and the voltage at node 16 rises. In this manner, the amplitude of the transducer output voltage at node 16 is adjusted.

The transducer output voltage at node 16 is filtered by capacitor 18. Diode 20 to voltage reference $V_{DD}$ provides overshoot protection to protect the solid state chips in the circuit. The transducer output voltage from node 16 is then applied through FET 22 and reduced by the voltage divider network provided by resistors 24 and 26 and applied to the noninverting input 27 of comparator 28, provided by an operational amplifier. Conduction of FET 22 is controlled by a monostable multivibrator timer 30, provided by a CD 4538 timer with manufacturer-assigned pin numbers shown. Timer 30 has a one millisecond timing interval set by the RC timing circuit provided by resistor 32 and capacitor 34. The ignition pulse signal voltage on line 36 is reduced by the voltage divider network provided by resistors 38 and 40 and filtered by capacitor 42 and applied to timer 30. In response to such ignition pulse, the Q output of timer 30 goes high for one millisecond, and then goes low until the next ignition pulse.

The Q output of timer 30 is connected to control terminal 44 of FET 22 and biases the latter into conduction for the noted one millisecond interval, which provides the above noted first phase or timing interval for dead-time sampling of sensed background noise. During this interval, transducer output voltage from node 16 is applied through conductive FET 22 to the noninverting input 27 of comparator 28 for comparison against a reference voltage at the comparator's inverting input 29 supplied from a voltage source provided by the Q output of timer 94, to be described, through the voltage divider network provided by resistors 46 and 48. Capacitor 50 provides filtering between the inverting and noninverting comparator inputs. The higher the voltage amplitude at comparator input 27 relative to comparator input 29, the higher the voltage amplitude at comparator output 52. The comparator output voltage is supplied through resistor 54 to control terminal 56 of FET 14 to bias the latter into conduction, the higher the bias the more the conduction.

In operation during the noted initial one milisecond interval following an ignition pulse, an increase in sensed background noise will cause a higher amplitude transducer output voltage at node 16, which is applied through conductive FET 22 to comparator input 27, which in turn increases the bias at comparator output 52 applied to FET control terminal 56, which in turn increases conduction of FET 14, which in turn lowers the transducer output voltage at node 16 through resistor 62. Conversely, a reduction in sensed background noise provides a reduced amplitude transducer output voltage at node 16, which is applied through conductive FET 22 to comparator input 27, which in turn reduces the comparator output bias at output 52 applied to control terminal 56, which in turn reduces conduction of FET 14, which in turn increases transducer output voltage at node 16. This automatic control of the gain of FET 14 provides conduction modulation according to sensed background noise, which in turn affects the transducer output voltage at node 16. This self-adaptation is provided by transistor 14 in the feedback loop to comparator input 27. The automatic gain control is gated by timer 30 and FET 22.

A detonation threshold detector includes operational amplifier 58, having its noninverting input 60 connected to node 16 through resistor 66 and parallel diode 64. The inverting input 68 of comparator 58 is supplied with a reference voltage from voltage source $V_{DD}$ reduced by the voltage divider network provided by resistors 70 and 72 and supplied through resistor 74. The gain of op amp 58 is set by the feedback loop including resistors 76, 70 and 72, and filtering is provided by capacitor 78. When the voltage at op amp input 60 rises above that at op amp input 68, the op amp output 80 goes high, which high signal is supplied through diode 82 to output 84 providing a knock-detected signal for fuel enrichment.

As above noted, during the one millisecond initial timing interval, the circuit self-adapts to varying sensed background noise and provides gated automatic gain control to vary the transducer output voltage at node 16. During this interval, capacitor 86 at comparator input 27 charges. At the end of the one millisecond background noise sampling interval, the Q output of timer 30 goes low which turns off transistor 22. Charged capacitor 86 maintains voltage at comparator input 27 upon termination of such interval, in order to maintain the state at comparator output 52. Capacitor 88 at transistor control terminal 56 likewise has previously been charged during the initial interval, and upon termination of such interval will maintain a bias on control terminal 56 to maintain FET 14 conductive, to in turn maintain approximately the same resistance value across the main terminals of FET 14 between node 16 and ground. Capacitors 86 and 88 maintain a relatively smooth DC bias on respective terminals 27 and 56 at the end of the initial sampling interval to maintain the gain of transistor 14 until the next ignition pulse. The next ignition pulse will occur in about 2–2.5 milliseconds depending on engine speed.

Detonation threshold detector 58 responds to a predetermined increase in the amplitude of the transducer output voltage at node 16 above the amplitude representing sensed background noise, and outputs the knock-detected signal at output 84. During the initial timing interval, capacitor 90 at op amp input 60 charges from node 16 through resistor 66 and diode 64. Capacitor 90 also charges through resistor 53 from output 52 of comparator 28, to provide a higher charge on capacitor 90 for higher sensed background noise. During the initial timing interval, the voltage across capacitor 90 is not sufficient to trigger threshold detector 58. At the end of the initial one millisecond timing interval, capacitor 90 maintains a bias at comparator input 60. When detonation occurs, there is a substantial increase in the voltage at node 16. Detonation threshold detector 58 responds to the increase in the amplitude of the portion of the transducer output voltage representing detonation above the amplitude of the portion of the transducer output voltage representing sensed background noise, and outputs the noted knock-detected signal.

Fail-safe and idle override circuitry includes comparator 92 and monostable multivibrator timer 94, provided by a CD 4538 timer with manufacturer-assigned pin numbers shown. Comparator 92 responds to loss of transducer output voltage at node 10 to provide a knock-detected signal at output 84 in a fail-safe mode. Timer 94 responds to engine speed below a given or idle speed to prevent the fail-safe mode even if a low amplitude transducer output voltage, corresponding to low amplitude audio signals at idle, appears to be a loss of transducer output voltage.

Transducer output voltage at node 10 is supplied through resistor 96, filtered by capacitor 98 and supplied through resistor 100 to inverting input terminal 102 of comparator 92, provided by an operational amplifier. The noninverting input 104 of comparator 92 is supplied with a reference voltage from source $V_{DD}$ reduced by the voltage divider network provided by resistors 106 and 108. Resistor 110 is connected between comparator output 112 and input 104. Comparator output 112 is connected through resistor 114 and diode 116 and protective ground resistor 118 to output 84. During normal operation, transducer output voltage at node 10 biases comparator input 102 higher than input 104, such that comparator output 112 is low, and hence there is no knock-detected signal at output 84. Upon loss of the transducer output voltage at node 10, e.g. by a failure of transducer 2, or a loose connection, etc., the voltage at comparator input 102 drops below the voltage at comparator input 104, and comparator output 112 goes high, which in turn provides a knock-detected signal at output 84. This provides a fail-safe mode.

Timer 94 provides an idle override feature. The ignition pulse from line 36 through resistor 38 is applied at line 119 to timer 94. The $\overline{Q}$ output of timer 94 is connected through resistors 120 and 100 to comparator input 102. Timer 94 responds to ignition pulses and outputs timing pulses at its $\overline{Q}$ output including a negative polarity pulse 122 for a given interval 124 set by the RC timing circuit provided by resistor 126 and capacitor 128, followed by a positive polarity pulse 130 for the interval 132 until the next ignition pulse. At low engine speed, there is sufficient duration of positive polarity pulse 130 to maintain the voltage at comparator input 102 above that at comparator input 104. This disables comparator 92 from generating a knock-detected signal at output 84 regardless of a decrease in transducer output voltage at node 10 which would otherwise decrease the voltage at comparator input 102 below that at comparator input 104.

With increasing engine speed above idle or above some given value, the duration of positive polarity pulses 130 becomes shorter because the next ignition pulses occur sooner. There is then insufficient duration of positive polarity pulses 130 to maintain the voltage at comparator input 102 above that at input 104, and hence comparator 92 is controlled by the transducer output voltage at node 10 supplied to comparator input 102, and comparator 92 generates a knock-detected signal at output 84 when the voltage at input 102 drops below that at input 104.

The fail-safe and idle override circuitry responds to loss of transducer output voltage at node 10 to provide the knock-detected signal at output 84 in a fail-safe mode. The circuitry responds to engine speed below a given speed and prevents the fail-safe mode even if a low amplitude transducer output voltage at node 10, corresponding to low amplitude audio signals at idle, appears to be a loss of transducer output voltage. At engine speeds above idle, input 102 of comparator 92 is controlled solely by the transducer output voltage at node 10 through resistor 96.

Timer 94 outputs timing pulses at its Q output including a positive polarity pulse 134 for the noted given interval 124, followed by a negative polarity pulse 136 for the noted interval 132 until the next ignition pulse. With increasing engine speed, the duration of negative polarity pulses 136 becomes shorter because the next ignition pulses occur sooner, and hence there is increasing voltage at inverting input 29 of comparator 28. Conversely, the reference voltage at comparator input 29 decreases with decreasing engine speed. At low engine speeds, below 3,000 rpm, the voltage at comparator input 29 is low enough that comparator output 52 will remain high, which in turn keeps FET 14 conductive, which in turn provides minimum voltage at node 16 during the initial timing interval, thus disabling knock detecting during initial engine acceleration.

The cold start fuel enrichment circuit 202 includes an NTC, negative temperature coefficient, thermistor 204 sensing engine temperature, as known in the art, for example NTC thermistor 66 in said U.S. Pat. No. 4,349,000, and NTC thermistor 81 in U.S. Pat. No. 4,429,673, incorporated by reference. The engine includes a battery 206 and a start switch 208 for applying battery voltage to start solenoid 210 to crank and start the engine. A voltage source $V_{DD}$ continually biases thermistor 204 through resistor 212 at node 214 such that the voltage across thermistor 204 continually varies with engine temperature and provides an output fuel enrichment signal through diode 216 to output node 84, which output node also receives a fuel enrichment signal through diodes 82 and/or 116 from knock detection circuitry, to be described, to supply a richer fuel-air mixture, U.S. Pat. Nos. 4,243,009 and 4,667,637, incorporated herein by reference.

At cold start, engine temperature is low and the resistance of NTC thermistor 204 is high, whereby a large portion of $V_{DD}$ is dropped across thermistor 204 such that a high voltage value is present at node 214, which in turn provides the fuel enrichment signal at output node 84. As engine temperature increases, the resistance of NTC thermistor 204 decreases, and thermistor 204 conducts more current therethrough from voltage source $V_{DD}$, whereby to lower the voltage at node 214, reducing or eliminating the fuel enrichment signal at output node 84 through diode 216.

Diode 218 and resistor 220 connect battery 206 through switch 208 and start solenoid 210 to thermistor 204 at node 214 such that battery voltage additionally biases the thermistor during cranking of the engine. Capacitor 222 provides filtering and spike suppression. During cranking of the engine, the voltage at node 214 across thermistor 204 providing the fuel enrichment signal includes components of both battery 206 and voltage source $V_{DD}$. After cranking, the fuel enrichment signal at node 214 includes the component from voltage source $V_{DD}$, but not from battery 206. The voltage at node 214 forward biases diode 216 and provides the fuel enrichment signal at output node 84.

The fuel enrichment signal from the cold start circuitry is provided through diode 216 to output node 84. The fuel enrichment signal from the knock detection circuitry is provided through diode 82 to output node 84. The fuel enrichment signal from the fail-safe and idle override circuitry is provided through diode 116 to output node 84. Diodes 216, 82 and 116 provide isolation such that output node 84 operates as an OR gate. Diode 216 passes the fuel enrichment signal from node 214 to output node 84, and blocks passage of the fuel enrichment signal from output node 84 to node 214. Diode 82 passes the fuel enrichment signal from output 80 of comparator 58 of the knock detection circuitry to output node 84, and blocks passage of the fuel enrichment signal from output node 84 to output 80 of comparator 58. Diode 116 passes the fuel enrichment signal from output 112 of comparator 92 of the fail-safe and idle override circuitry to output node 84, and blocks passage of the fuel enrichment signal from output node 84 to output 112 of comparator 92.

It is recognized that various equivalents, alternatives and modifications are possible within the scope of the appended claims.

We claim:

1. A two cycle internal combustion engine having a fuel pump drawing fuel from a fuel tank, comprising:

a piston reciprocal in a cylinder between a crankcase and a combustion chamber;

said piston having a charging stroke in one direction compressing fuel-air mixture in said combustion chamber and creating a vacuum in said crankcase, and having a power stroke upon combustion of said mixture driving said piston in the opposite direction pressurizing said crankcase and forcing fuel-air mixture to flow from said crankcase through said transfer passage means to said combustion chamber for repetition of the cycle;

carburetor means receiving fuel from said fuel pump and supplying fuel to said intake manifold;

auxiliary fuel enrichment means comprising:

a first fuel line having an inlet connected to said fuel pump, and having an outlet;

a control valve connected to said outlet of said first fuel line, said control valve having an OFF state blocking fuel flow from said first fuel line, said control valve having an ON state passing fuel flow from said first fuel line, said control valve being operable between said ON and OFF states during running of said engine, including high speed operation where detonation may occur;

a second fuel line having an inlet connected to said control valve, and having an outlet, said control valve blocking fuel flow from said first fuel line to said second fuel line in said OFF state, said control valve passing fuel flow from said first fuel line to said second fuel line in said ON state;

metering orifice means connected to said outlet of said second fuel line and having a giver restriction orifice metering fuel flow;

a third fuel line having an inlet connected to said metering orifice means and receiving fuel flow across said restriction orifice from said second fuel line, said restriction orfice providing a pressure drop thereacross from said second fuel line to said third fuel line to provide lower fuel pressure in said third fuel line and reducing fuel pressure fluctuations in said third fuel line otherwise due to cycling of said control valve between said ON and OFF states, said third fuel line having an outlet connected to said intake manifold to supply extra fuel thereto, said reduced fuel pressure in said third fuel line reducing the chance of fuel leakage at said intake manifold, said control valve being variably cycled between said ON and OFF states and providing a continuous uninterrupted supply of fuel in said third fuel line during all engine operation, said cycling of said control valve limiting and controlling the rate of fuel flow through said third fuel line.

2. The invention according to claim 1 wherein said carburetor means includes a fuel flow orifice, and wherein said restriction orifice of said metering orifice means is smaller than said carburetor fuel flow orifice.

3. The invention according to claim 2 comprising a 150 micron filter immediately downstream of said fuel pump, and a 75 micron filter immediately upstream of said restriction orfice of said metering orifice means.

4. The invention according to claim 1 wherein said engine comprises a multicylinder engine, and wherein said metering orifice means comprises an integral housing having an inlet connected to said outlet of said second fuel line, said housing having a plurality of outlets, one for each cylinder, and comprising a plurality of said third fuel lines, one for each said cylinder, each of said outlets of said housing being connected to a respective said inlet of a respective one of said third fuel lines.

5. The invention according to claim 4 wherein said housing defines an internal plenum common to said housing inlet and each of said housing outlets.

6. The invention according to claim 5 comprising fuel filter means mounted in said housing within said plenum such that fuel flow from said housing inlet to said housing outlets passes through said filter means.

7. The invention according to claim 4 wherein said metering orifice means is provided by said housing outlets, each said housing outlet having said given restriction orifice for its respective said third fuel line.

8. The invention according to claim 1 comprising:

transducer means sensing audio signals indicative of engine combustion and occuring within said combustion chamber of said engine and converting said audio signals into an electrical output voltage including a portion representing background noise a portion representing detonation;

electronic control means responsive to said electrical output voltage from said transducer means representing detonation, and outputting a fuel enrichment signal, said control valve being responsive to said fuel enrichment signal.

9. The invention according to claim 8 comprising fail-safe and idle override means responsive to loss of said transducer output voltage to provide said fuel enrichment signal in a fail-safe mode, and responsive to engine speed below a given speed and preventing said fail-safe mode even if a low amplitude transducer output voltage, corresponding to low amplitude audio signals at idle, appears to be a loss of said transducer output voltage.

10. The invention according to claim 8 comprising second transducer means sensing engine temperature and converting engine temperature into an electrical output voltage, and wherein said electronic control means is also responsive to said second transducer means and outputs said fuel enrichment signal to said control valve according to engine temperature, to supply additional fuel when said engine is cold.

11. The invention according to claim 10 wherein said engine includes a battery and a start switch for applying battery voltage to crank and start said engine, wherein said second transducer means comprises a thermistor, and comprising:

a voltage source biasing said thermistor such that the voltage across said thermistor varies with engine themperature and provides an output fuel enrichment signal;

means connecting said battery through said start switch to said thermistor such that battery voltage additionally biases said thermistor during cranking of the engine.

12. The invention according to claim 1 comprising:

free running variable duty cycle oscillator means connected to said control valve and having a cycle with an ON portion actuating said control valve to said ON state, and an OFF portion actuating said control valve to said OFF state;

means outputting a fuel mixture signal to said variable duty cycle oscillator means and varying the duty cycle thereof.

13. The invention according to claim 12 comprising semiconductor switch means controlling actuation of said control valve, and wherein said variable duty cycle oscillator means comprises a comparator having a first input from said means outputting said fuel mixture signal, and having an output controlling conduction of said semiconductor switch means.

14. The invention according to claim 1 comprising:

means responsive to a given engine parameter and outputting a fuel enrichment signal;

free running variable duty cycle oscillator means responsive to said fuel enrichment signal and having a cycle with an ON portion actuating said control valve to said ON state and having an OFF portion acturating said control valve to said OFF state.

15. The invention according to claim 14 wherein said control valve comprises a solenoid continuously cyclicable having a pair of main terminals connected in series with said solenoid for completing a circuit therethrough from a voltage source when said transistor means is conductive, said transistor means having a control terminal for biasing said transistor means into conduction, and wherein said varible duty cycle oscillator means is connected to said control terminal of said transistor means and biases the latter into conduction during said ON portion of said cycle, and wherein said transistor means is nonconductive during said OFF portion of said cycle.

16. The invention according to claim 15 wherein said variable duty cycle oscillator means comprises a comparator having an output connected to said control terminal of said transistor means, and having a first input receiving said fuel enrichment signal, and having a second input connected to a capacitor which is charged by said output of said comparator through a first resistor connected from said output of said comparator to a node betwen said capacitor and said second input of said comparator, and comprising voltage limiting means connected to said node to limit the voltage at said second input of said comparator, said second input of said comparator providing a reference determined by the charge on said capacitor for comparison against said first input of said comparator such that said output of said comparator transitions high when the voltage at said first input of said comparator exceeds the voltage at said second input of said comparator, and such that said output of said comparator transitions low when the charge on said capacitor and the voltage at said second input of said comparator exceeds the voltage at said first input of said comparator, and such that when the fuel enrichment voltage at said first input of said comparator exceeds a give value, said output of said comparator remains high because said voltage limiting means prevents the voltage at said second input of said comparator means from exceeding that at said first input of said comparator means, such that said transistor means remains conductive and said solenoid remains in said ON state and does not cycle to said OFF state, to provide maximum fuel enrichment.

17. The invention according to claim 16 comprising a second resistor connected in series with a diode, said series connected second resistor and siad diode being connected in parallel with said first resistor from said node to said output of said comparator, such that said comparator charges from said output of said comparator through said first resistor, and discharges through said second resistor and said diode to said output of said comparator, and comprising second voltage dropping means connected between said first input of said comparator and said second output of said comparator such that when the charge on said capacitor and the voltage at said second input of said comparator exceeds the voltage at said first input of said comparator and said output of said comparator transitions low, said voltage dropping means lowers the voltage at said first input of said comparator to a given voltage difference above the voltage at said output of said comparator such that said capacitor must discharge to a level below said lowered voltage of said first input of said comparator before said output of said comparator can again transition high.

18. The invention according to claim 17 comprising a positive temperature coefficient thermistor connected in series between said solenoid and said transistor means, said thermistor being heated by excessive current flow therethrough to a blocking condition to block current flow through said transistor means to protect the latter from a defective or shorted solenoid.

19. The invention according to claim 18 wherein said solenoid has a first terminal connected to a battery, and a second terminal connected through a second diode and said thermistor to said transistor means, said second terminal of said solenoid also being connected through a third diode to said battery, such that when said transistor means is ON, current flows from said battery through said solenoid and said second diode and second thermistor, and when said transistor means turns OFF, inductive current from said solenoid flows through said third diode to said battery, to limit said inductive current during cycling of said solenoid.

20. The invention according to claim 14 comprising in combination:

transducer means sensing audio signals indicative of engine combustion and occuring within said combustion chamber and converting said audio signals into an electrical output voltage including a portion representing background noise and a portion representing detonation;

means for adjusting the amplitude of said transducer output voltage;

means sampling said portion of said transducer output voltage representing background noise and controlling said adjusting means to decrease the amplitude of said transducer output voltage for increased sensed background noise and to increase the amplitude of said transducer output voltage for decreased sensed background noise;

detonation threshold means responsive to a predetermined increase in the amplitude of said portion of said transducer output voltage representing detonation above the amplitude of said portion of said transducer output voltage representing background noise, and outputting a fuel enrichment signal to an output node;

a thermistor connected to said output node and sensing engine temperature;

a voltage source biasing said thermistor such that the voltage across said thermistor varies with engine temperature and provides an output fuel enrichment signal at said output node;

first isolation means isolating said fuel enrichment signal of said detonation threshold means from said thermistor and said voltage source;

second isolation means isolating said fuel enrichment signal of said thermistor and said voltage source from said detonation threshold means;

said first isolation means comprising a first diode connected in series aiding relation from said detonation threshold means to said output node and passing the fuel enrichment signal from said detonation threshold means to said output node and blocking passage of the fuel enrichment signal from said output node to said detonation threshold means;

said second isolation means comprising a second diode connected in series aiding relation from a node between said thermistor and said voltage source to said output node, and passing the fuel enrichment signal from said second mentioned node to said output node, and blocking passage of the fuel enrichment signal from said output node to said second;

combination fail-safe and idle override means comprising means responsive to loss of said transducer output voltage to provide a fuel enrichment signal at said output node, and responsive to engine speed below a give speed and preventing said fail-safe mode even if a low amplitude transducer output voltage, corresponding to low amplitude audio signals at idle, appears to be a loss of said transducer output voltage;

third isolation means comprising a third diode connected in series aiding relation from said fail-safe and idle override means to said output node, and passing the fuel enrichment signal from said fail-safe and idle override means to said output node, and blocking passage of the fuel enrichment signal from said output node to said fail-safe and idle override means;

said engine including a battery and a start switch, and comprising means connecting said battery through said start switch to said second node such that battery voltage biases said thermistor during cranking of said engine in addition to the bias from said voltage source, such that during cranking of the engine the voltage across said thermistor providing the fuel enrichment signal to said voltage source, and such that after cranking the fuel enrichment signal through said second diode includes the component from said voltage source but not said battery.

21. The invention according to claim 1 comprising:

transducer means sensing audio signals indicative of engine combustion and occuring within said combustion chamber of said engine and converting said audio signals into an electrical output voltage including a portion representing background noise and a portion representing detonation;

electronic control means responsive to said electrical output voltage from said transducer means representing detonation, and outputting a fuel enrichment signal;

free running variable duty cycle oscillator means responsive to said fuel enrichment signal and having a cycle within an ON portion and an OFF portion;

said control valve comprising a solenoid continuously cyclicable between said ON and OFF states;

transistor means having a pair of main terminals connected in series with said solenoid for completing a circuit therethrough from a voltage source when said transistor means is conductive, said transistor means having a control terminal for biasing said transistor means into conduction, and wherein said variable duty cycle oscillator means is connected to said control terminal of said transistor means and biases the latter into conduction during said ON portion of said cycle, and wherein said transistor means is nonconductive during said OFF portion of said cycle.

22. The invention according to claim 21 comprising:

fail-safe and idle override means responsive to loss of said transducer output voltage to provide said fuel enrichment signal in a fail-safe mode, and responsive to engine speed below a given speed and preventing said fail-safe mode even if a low amplitude transducer output voltage corresponding to low amplitude audio signals at idle, appears to be a loss of said transducer output voltage;

second transducer means sensing engine temperature and converting engine temperature into an electrical output voltage, and wherein said variable duty cycle oscillator means is responsive to said second transducer means to control conduction of said transistor means and cycling of said solenoid according to engine temperature, to supply additonal fuel to said engine when said engine is cold.

* * * * *

UNITED STATES PATENT AND TRADEMARK OFFICE

CERTIFICATE OF CORRECTION

PATENT NO. : 4,777,913

DATED : October 18, 1988

INVENTOR(S) : RICHARD E. STAERZL ET AL

It is certified that error appears in the above-identified patent and that said Letters Patent is hereby corrected as shown below:

Col. 11, line 11, claim 11, delete "themperature" and substitute therefor -- temperature --; Col. 11, line 40, claim 14, delete "acturating" and substitute therefor -- actuating --; Col. 11, line 44, claim 15, after "cyclicable" insert -- between said ON and OFF states, and comprising transistor means --; Col. 11, line 63, claim 16, delete "betwen" and substitute therefor -- between --; Col. 12, line 21, claim 17, delete "siad" and substitute therefor -- said --; Col. 13, line 42, claim 20, after "second" insert -- node --; Col. 13, line 47, claim 20, delete "give" and substitute therefor -- given --; Col. 14, line 8, claim 20, after "said" insert -- second diode includes components of both said battery and said --.

Signed and Sealed this

Twenty-fourth Day of October, 1989

*Attest:*

DONALD J. QUIGG

*Attesting Officer*

*Commissioner of Patents and Trademarks*